US009102504B1

(12) United States Patent
Finfrock et al.

(10) Patent No.: US 9,102,504 B1
(45) Date of Patent: Aug. 11, 2015

(54) TRUSS LIFTING APPARATUS AND PROCESS

(71) Applicants: Robert D Finfrock, Orlando, FL (US); Allen R Finfrock, Winter Park, FL (US)

(72) Inventors: Robert D Finfrock, Orlando, FL (US); Allen R Finfrock, Winter Park, FL (US)

(73) Assignee: Finfrock Industries, Inc., Apopka, FL (US)

( * ) Notice: Subject to any disclaimer, the term of this patent is extended or adjusted under 35 U.S.C. 154(b) by 0 days.

(21) Appl. No.: 14/533,173

(22) Filed: Nov. 5, 2014

(51) Int. Cl.
*B66C 1/00* (2006.01)
*B66C 1/28* (2006.01)

(52) U.S. Cl.
CPC ..... *B66C 1/28* (2013.01)

(58) Field of Classification Search
CPC ..... B66C 1/12; B66C 1/10; B66C 1/24; B66C 1/22; B66C 1/34; B66C 1/28; E21B 19/04; C21C 5/441; E04F 21/1822; E04G 23/06; A47B 96/1408; E04C 2003/0491; E04C 3/292; E04H 12/34
USPC ..... 414/10–12; 52/633, 691–693, 745.17
See application file for complete search history.

(56) References Cited

U.S. PATENT DOCUMENTS

| | | | | |
|---|---|---|---|---|
| 3,522,670 | A * | 8/1970 | Frederick et al. | 37/314 |
| 3,788,578 | A * | 1/1974 | Sweeney et al. | 244/3.28 |
| 3,977,536 | A * | 8/1976 | Moore et al. | 414/11 |
| 4,571,825 | A * | 2/1986 | Skibsted | 29/823 |
| 7,891,150 | B2 | 2/2011 | Finfrock et al. | |
| 8,667,755 | B1 | 3/2014 | Finfrock et al. | |
| 8,763,333 | B1 | 7/2014 | Finfrock et al. | |

* cited by examiner

*Primary Examiner* — Stephen Vu
(74) *Attorney, Agent, or Firm* — William M. Hobby, III

(57) ABSTRACT

A truss lifting process and apparatus for coupling a lifting truss to a load to be lifted especially for lifting a large prefabricated concrete panel in the making of a dual panel truss having a pair of spaced apart concrete panels. A lifting truss has a plurality of spaced hydraulic cylinders hanging therefrom with each hydraulic cylinder having a grappling hook attached thereto for attaching to an attachment member on an object to be lifted. The plurality of hydraulic cylinders are actuated simultaneously to pull each coupled grappling hook and attachment member taut and then locked for the lifting truss to lift the attached object.

14 Claims, 3 Drawing Sheets

TRUSS LIFTING APPARATUS AND PROCESS

FIELD OF THE INVENTION

This invention relates to a truss lifting process and apparatus and especially to a process for coupling a lifting truss to a load to be lifted such as a large prefabricated concrete panel in the making of a dual panel truss having a pair of spaced apart concrete panels.

BACKGROUND OF THE INVENTION

Prefabricated double wall concrete components have been used in the past to construct building walls. Such wall members may include a plurality of welded wire spacing frames to retain the slabs of the wall member in a spaced apart configuration. Typically, the welded wire spacing frames provide limited structural reinforcement of the wall member. It has been proposed to use such prefabricated wall members as structural flooring and/or roofing members. However, a dual slab member designed as a wall may not be readily adaptable to a floor or roofing application due to different loading forces on the member. For example, a wall member used in a floor application may have a limited span distance due to the minimum structural capacity provided by the welded wire spacing frames. More robust welded steel trusses having upper and lower longitudinal portions embedded in respective upper and lower slabs have been proposed as a framing structure for a composite truss that can span up to 60 feet and greater. However, the great weight of these large dual panel prefabricated trusses raises problems of lifting and moving the a truss without damaging the truss panels. It becomes desirable to incorporate means in a truss during manufacture of the truss for connecting lifting cables or hooks which can support the great weight of the truss. Attachment techniques used in the manufacture of such framing structures significantly adds to the cost and time needed to manufacture the trusses and thereby increases the cost of the composite truss.

In our prior U.S. Pat. No. 8,667,755 for a Dual Panel Composite Truss Apparatus, a dual panel truss has a pair of spaced apart prestressed concrete panels having a versatile and adaptive structurally supporting end bearing truss on the ends thereof. The end bearing truss incorporates a versatile and adaptive structural support on each end of the composite truss. The end bearing truss is formed as an integral part of the composite truss for supporting the ends of the composite truss when the composite truss is used for the floors and ceiling of a building. The end bearing truss advantageously forms each end of each concrete panel form for the concrete pour when making each concrete panel. This prior patent is an improvement of our prior U.S. Pat. No. 7,891,150 for a Composite Truss by Robert D. Finfrock and Allen R. Finfrock. In this prior patent, a composite truss has a pair of spaced apart prestressed concrete panels and a plurality of substantially vertical members spanning between the pair of spaced apart concrete panels, one end portion of each vertical member being embedded in one of the spaced apart concrete panels and the opposite end being imbedded in the other concrete panel. The truss includes a diagonal member spanning between the one end of a vertical member and the other end of an adjacent vertical member. Each end of the diagonal member non-structurally engages an end of a vertical member. Each diagonal member also has a length thereof embedded in the concrete in each spaced apart concrete panel. Each end of the composite truss has a prefabricated concrete end bearing beam for supporting the end of the composite truss.

Our prior U.S. Pat. No. 8,763,333 is for a method of making a dual panel composite truss having a pair of spaced apart prestressed concrete panels. The process includes assembling the truss frame, which includes interconnecting and mounting a plurality of steel posts and connecting truss members and reinforcing rods, and positioning the assembled truss frame in a panel form having prestressed strands therein for pouring a first prestressed concrete panel on one side of the truss frame. The truss frame with the first concrete panel is then stripped from the form, lifted and placed on a turning table and turned to position the other side of the truss frame in the panel form for pouring concrete into the panel form for pouring the second prestressed concrete panel.

Care must be taken in lifting the truss frame after curing one concrete panel for placement on the turning table to avoid any damage to the first concrete panel. The dual concrete panel truss does not reach full strength until both concrete panels form the completed composite dual concrete panel truss. This requires all the lifting points for lifting the truss frame having one concrete panel formed thereon to have some force thereon so that the concrete panel is being lifted by all the points to avoid damaging the concrete panel. Once the truss frame having one panel is lifted and placed on a turning table, it is turned to place the truss frame in a mold for forming the second panel of the composite truss.

The present invention is for a truss lifting process and apparatus for coupling a lifting truss to a load to be lifted especially for lifting a large prefabricated concrete panel in the making of a dual panel truss having a pair of spaced apart concrete panels. A lifting truss has a plurality of spaced hydraulic cylinders hanging therefrom with each hydraulic cylinder having a grappling hook attached thereto for attaching to an attachment member on an object to be lifted. The plurality of hydraulic cylinders are actuated simultaneously to pull each coupled grappling hook and attachment member taut and then locked for the lifting truss to lift the attached object.

SUMMARY OF THE INVENTION

This invention relates to a method of making a dual panel composite truss having a pair of spaced apart prestressed concrete panels for use in a building floor and ceiling and to a process for lifting a dual panel composite truss or part thereof. A truss frame has a pair of spaced apart prestressed concrete panels spaced by a plurality of frame members.

The process for lifting large panels includes using an elongated lifting truss having lifting cables attached thereto for lifting the lifting truss. The lifting truss has a plurality of hydraulic cylinders attached thereto in a spaced relationship to each other with each hydraulic cylinder having a hydraulic rod movable in and out of the hydraulic cylinder responsive to changes in the hydraulic pressure of the hydraulic fluid in the hydraulic cylinder. A hydraulic fluid pump is connected to a source of hydraulic fluid and a pair of hydraulic fluid lines are connected between the hydraulic fluid pump and each hydraulic cylinder for simultaneously varying the hydraulic fluid pressure in each of the plurality of hydraulic cylinders for moving the cylinder rods in the cylinder. Each of a plurality of grapple hooks is movably attached to a hydraulic cylinder rod and positioned for connecting to a different spaced attachment member on the object to be lifted. The lifting truss is positioned over an object to be lifted and each of the plurality of grapple hooks is attached to a separate attachment member on the object to be lifted. The plurality of hydraulic cylinders are simultaneously actuated to bring each grapple hook on each attachment member on the object taut without any slack between any grapple hook and its attachment member. The lifting truss is then lifted with the attached object attached thereto with each coupling bearing weight. The lifting truss can lift an object with each of the plurality of attachment points on the object bearing some weight.

BRIEF DESCRIPTION OF THE DRAWINGS

The accompanying drawings, which are included to provide further understanding of the invention, are incorporated in and constitute a part of the specification and illustrate an embodiment of the invention and together with the description serve to explain the principles of the invention.

In the drawings.

DETAILED DESCRIPTION OF AN EXEMPLARY EMBODIMENT

Our prior method of making a dual panel composite truss having a pair of spaced apart prestressed concrete panels included assembling a truss frame, which included connecting a plurality of steel posts and bent rod truss members and reinforcing rods to form a truss frame and lifting and placing the assembled truss frame in a panel form for pouring a first prestressed concrete panel on one side of the truss frame. The truss frame with the first concrete panel is then stripped, lifted and placed on a turntable and turned to place the other side of the truss frame in the panel form for pouring a second concrete panel, to form a dual panel composite truss having parallel spaced prestressed concrete panels as set forth in our prior U.S. Pat. No. 8,763,333 dated Jul. 1, 2014. The present invention is for an apparatus for lifting an object, such as a dual panel composite truss and especially for lifting the truss frame when the first concrete panel is being stripped, and lifted for placement onto a turning table for placing the other side of the truss frame in a panel form for pouring a second prestressed concrete panel to form a composite dual concrete panel truss. Because of their weight, large concrete panels must be lifted with care to avoid damage to the panel. The truss frame with the first concrete panel requires multiple lift points with each bearing of some of the weight with no slack between in the lift points to avoid damage by some lifting points not bearing weight to prevent damage to the truss panel and frame while lifting and placing the truss frame with one panel on the turning table.

Figure 1:
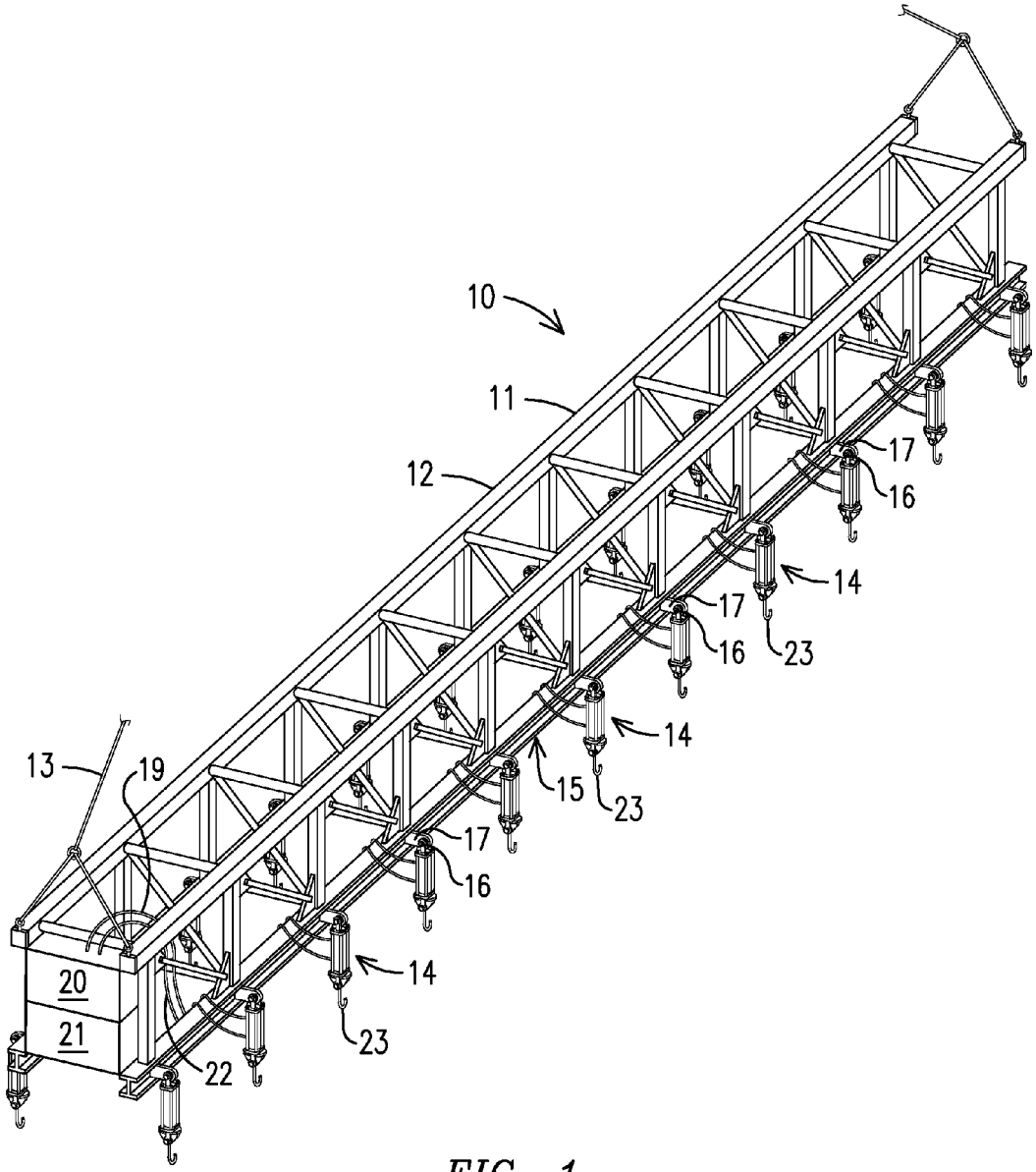
FIG. 1 is a perspective view of a lifting truss in accordance with the present invention.
Figure 2:
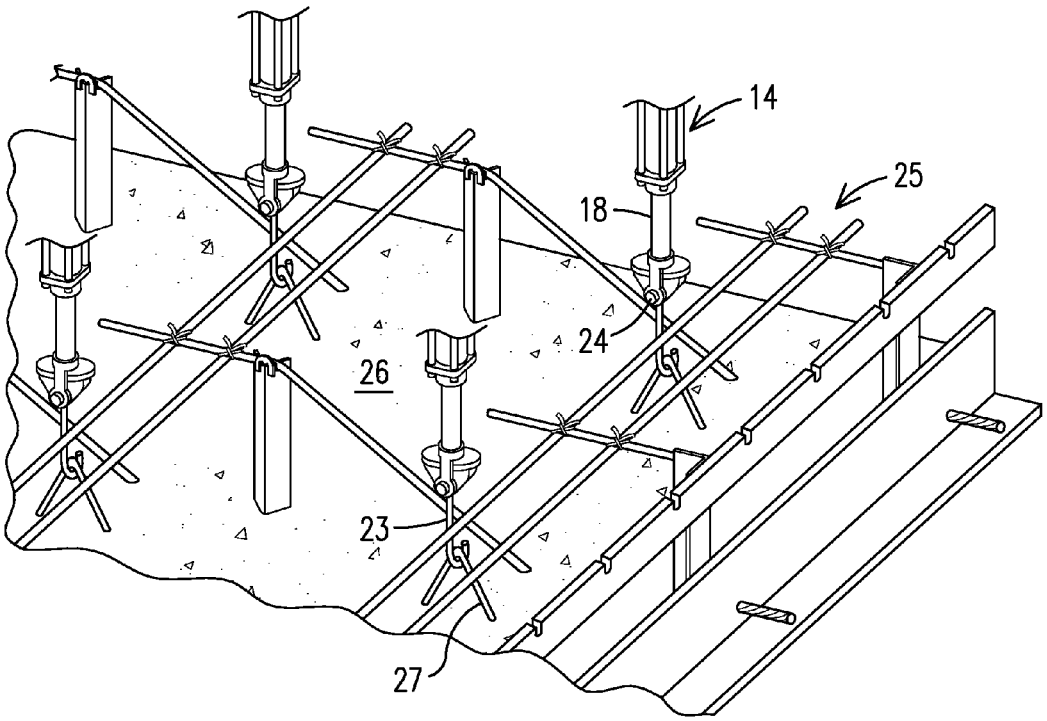
FIG. 2 is a partial perspective view of a partially finished composite truss having the first panel formed thereon being lifted by the lifting truss of FIG. 1.
Figure 3:
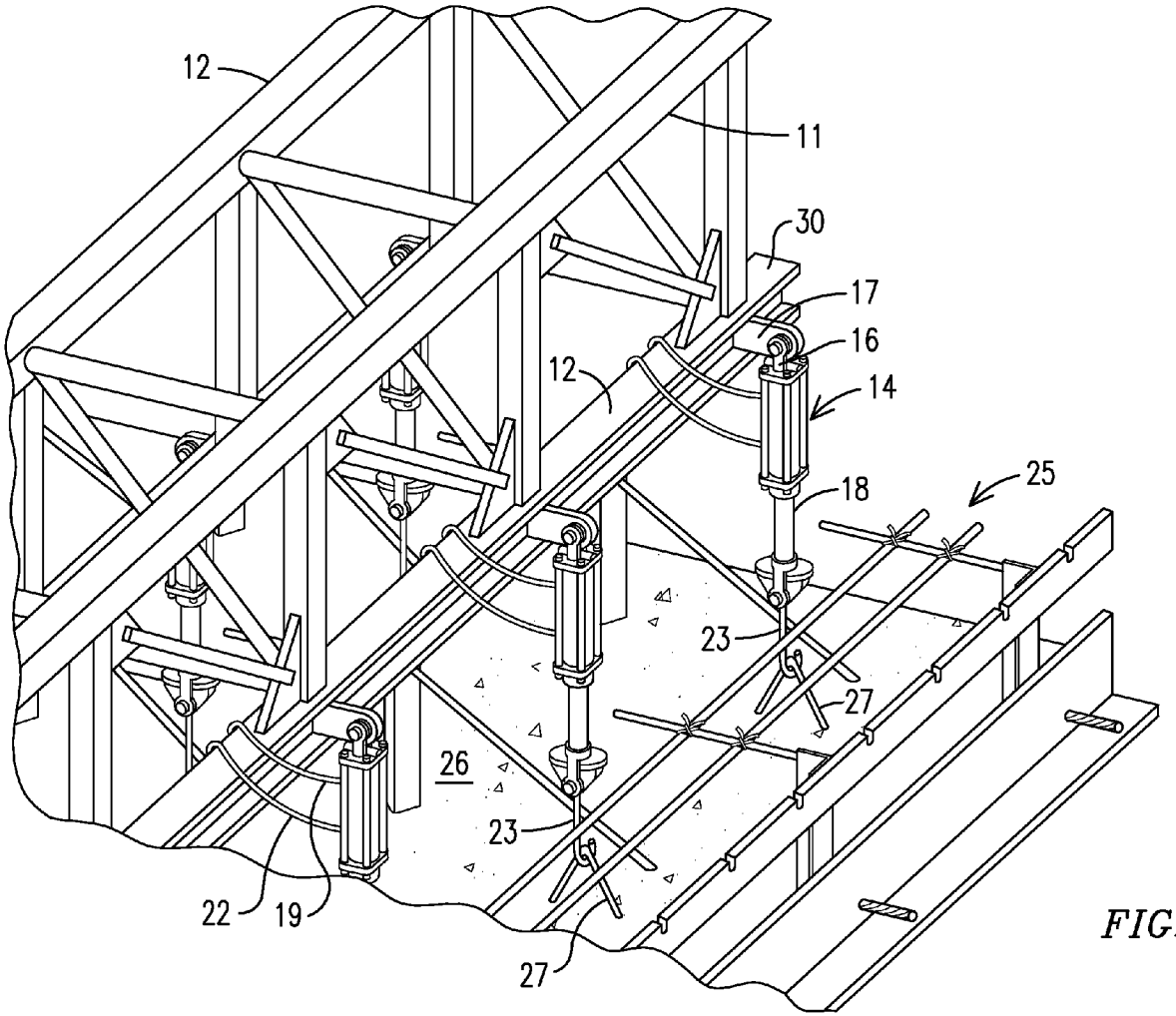
FIG. 3 is a partial perspective view of a partially finished composite truss having the first panel formed thereon being lifted by the lifting truss of FIG. 1.

Referring to the drawings FIGS. 1 through 4 and especially to FIG. 1, a lifting apparatus 10 includes an elongated lifting truss 11 which has a plurality of steel truss members 12. The lifting truss, which must be a very rigid truss, has lifting cables 13 attached to each end which can be attached to a crane or winch, or the like, for lifting the lifting truss 11. A plurality of hydraulic cylinders 14 are each movably attached to the horizontal truss frame members 15 using a yoke 16 pinned to protruding stud 17. Each hydraulic cylinder 14 has a cylinder rod 18 which can extend and retract from the cylinder 14 as hydraulic fluid thereinside is pressurized to drive the cylinder piston to extend or retract the cylinder rod 18. The direction of flow through the hydraulic fluid lines 19 and 22 from the hydraulic pump 20 into each cylinder determines whether the piston in the hydraulic cylinder 14 moves the piston rod 18 in or out of the cylinder 14. A hydraulic fluid reservoir 21 is connected to the pump 20 from which hydraulic fluid flows through hydraulic fluid lines 19 and 22 leading from the pump 20 to each end of each hydraulic cylinder 14. Each hydraulic cylinder 14 rod 18 has a grapple hook 23 movably attached thereto as seen in FIGS. 2 and 3. Each grapple hook 23 is pinned with a pin 24 to each hydraulic cylinder rod 18 allowing for movement of the grapple hook 23.

As seen in FIGS. 2 and 3, the lifting truss 11 can be positioned over an unfinished composite truss frame 25 having one prestressed panel 26 on one side thereof. Each grapple hook 23 is hooked onto one of a plurality of attachment members 27. The attachment members 27 have been formed into the composite truss frame 25 in the concrete panel 26 in predetermined spaced locations to co-inside with the position of the hydraulic cylinder grapple hooks 23 on the lifting truss 11.

When all the grapple hooks 23 are connected to all the attachment members 27, the operation of the hydraulic pump 20 can apply the desired hydraulic pressure to all the hydraulic cylinders 14 to pull the cylinder rods 18 to tighten all of the grapple hooks 23, leaving no slack in any of the connections of the grapple hooks and its associated attachment member 27. A predetermined lifting force is placed on all the hydraulic cylinders 14 from the pump 20 through the hydraulic fluid lines 19 and 22 to lift all the grapple hooks to remove any slack between any of the grapple hooks 23 and the attachment members 27 to make a taut connection without enough force to lift any point on the panel of the composite truss 25. No lifting force is used to lift the object by the grapple hooks which have only been pulled taut. Thus a force of 1 psi is all that is needed but typically a force of 200 psi might placed on the hydraulic cylinder rods to bring all the grapple hooks and attachment members taut. The hydraulic cylinders are then locked to lock the cylinder rods and attached grapple hooks and attachment members in place. The hydraulic cylinders are locked at the pump, or with a separate valve if desired, by blocking any movement of the hydraulic fluid in the hydraulic fluid lines 19 and 22 and in the cylinders 14. The lifting truss 11 can then be lifted by a crane or the like connected to the cables 13. Each attached hydraulic cylinder 14 and grapple hook 23 has a taut connection which assures that each attachment will have some lifting force thereon when the lifting truss is lifted to lift the object 25 being lifted. This in turn protects the partially finished composite truss 25 panel 26 from damage from some of the lifting points not bearing some of lifting weight. This allows the grapple hooks 23 to have a more uniform lifting forces throughout the lifting of a large panel and to avoid fracturing the concrete panel 25.

Figure 4:
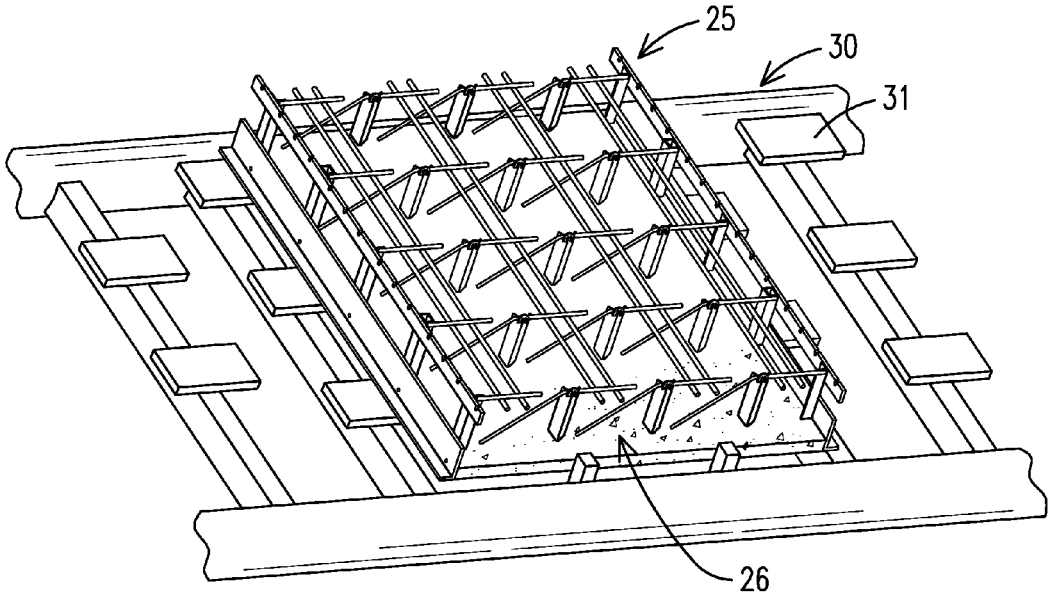
FIG. 4 is a partial perspective view of the truss frame having the first panel attached placed on a turning table for turning to position the other side of the truss frame in the concrete panel form for pouring a second concrete panel.

In the manufacture of a dual panel composite truss a first concrete panel 26 is formed on a truss frame having attachment members 27 spaced in predetermined positions to form a partial but incomplete composite one panel truss portion 25. The first concrete panel 26 needs to be stripped from the concrete form and lifted by the lifting truss 11 and transferred to a turn table 30 as seen in FIG. 4. The composite truss 25 having the first panel 26 and truss frame is then turned over or rotated by the turntable 30 to place the other side of the truss frame into a panel form. The turning table 30 plurality of vacuum plates 31 thereon grip one side of the concrete panel 26 for holding the panel thereto for turning the panel 26 and truss frame.

In a typically case a dual panel composite truss may be 65 feet long and weight 50,000 pounds with the partial truss 25 weighing 25,000 pounds while the lifting truss may be 70 feet long. A lifting truss 11 may have 22 hydraulic cylinders attached as shown in FIG. 1 and it is desirable to have no more than 1,100 pounds lifting force on any one lifting point.

The process for lifting large objects, such as large concrete panels, includes selecting an elongated and rigid lifting truss 11 having lifting cables 13 attached thereto for lifting the lifting truss with a crane or winch. The selected lifting truss has a plurality of hydraulic cylinders 14 attached thereto in a spaced relationship to each other with each hydraulic cylinder 14 having a hydraulic rod 18 movable in and out of the hydraulic cylinder 14 responsive to direction of flow and changes in the hydraulic pressure of the hydraulic fluid in the hydraulic cylinder 14. A hydraulic fluid pump connects to a source of hydraulic fluid and a pair of hydraulic fluid lines 19 and 22 are connected between the hydraulic fluid pump 20 and each hydraulic cylinder 14. The hydraulic pump varies the pressure and direction of flow in the fluid lines 19 and 22 and into each of the plurality of hydraulic cylinders 14. A grapple hook 23 is attached to each hydraulic cylinder rod 18 of each cylinder and positioned for connecting to different points on an object to be lifted.

The selected elongated truss 11 is then positioned over an object such as the panel 26 of the partial truss 25 to be lifted and each of the plurality of grapple hooks 23 is attached to a separate attaching member 27 formed in the panel 26 to be lifted. The panel 26 attachment members 27 that are formed therein and positioned to align with one grapple hook 23 from the lifting truss 11. Hydraulic fluid pressure is generated by the hydraulic fluid pump in the direction to pressurize the plurality of hydraulic cylinders 14 to place a small lifting force or load on each coupled grapple hook 23 and attachment member 27 on the panel 26 to be lifted. The hydraulic cylinders and cylinder rods are then locked in place with the hydraulic fluid with all grapple hooks 23 having taut connection to each attachment member 27. The lifting truss 11 is then lifted to lift the attached object 25 with each of a plurality of attachment points on the panel 25 having some lifting force thereon.

Each grapple hook 23 is movably attached to a hydraulic cylinder rod 18 and each hydraulic cylinder is movably attached to the lifting truss 11.

It should be clear at this time that a method and apparatus for lifting large panels or the like has been provided. However the present invention is not to be considered limited to the forms shown which are to be considered illustrative rather than restrictive.

We claim:

1. A process for lifting large objects comprising:

selecting an elongated lifting truss having lifting cables attached thereto for lifting the lifting truss, said lifting truss having a plurality of hydraulic cylinders attached thereto in a spaced relationship to each other, each of said hydraulic cylinders having a hydraulic cylinder rod movable in and out of said hydraulic cylinder responsive to the flow of hydraulic fluid through a pair of hydraulic fluid lines into and out of each of said hydraulic cylinders from a hydraulic fluid pump connected to a source of hydraulic fluid, each of said hydraulic cylinder rods having a grapple hook attached thereto and positioned for connecting to an attachment member on an object to be lifted;

positioning said lifting truss adjacent an object to be lifted;

attaching each of said plurality of grapple hooks to one said attachment member on an object to be lifted;

generating hydraulic fluid pressure with said hydraulic fluid pump in said plurality of hydraulic cylinders in a direction to retract each of said cylinder rods to tighten each of said grapple hooks to its associated attachment member and to retract each of said cylinder rods and grapple hooks onto said attachment member to bring taut to each of said grapple hooks with one of said plurality of attachment members; and lifting said lifting truss with said attached object;

whereby said lifting truss can lift an object with multiple lift points.

2. The process for lifting large objects in accordance with claim 1 in which the step of selecting an elongated lifting truss having a plurality of hydraulic cylinders each having a grapple hook attached to a cylinder rod includes each grapple hook being movably attached to one said hydraulic cylinder rod.

3. The process for lifting large objects in accordance with claim 2 in which the step of selecting an elongated lifting truss includes selecting said elongated lifting truss having a plurality of hydraulic cylinders each movably attached thereto.

4. The process for lifting large objects in accordance with claim 3 in which the step of selecting an elongated lifting truss includes selecting a elongated lifting truss having a pair of hydraulic fluid lines connected between said hydraulic fluid pump and each of said plurality of hydraulic cylinders for varying the flow of hydraulic fluid to each of said plurality of hydraulic cylinders to extend or retract the hydraulic cylinder rod in each of the hydraulic cylinders simultaneously.

5. The process for lifting large objects in accordance with claim 4 in which said object being lifted is a dual panel composite truss.

6. The process for lifting large objects in accordance with claim 4 in which said object being lifted is a truss frame having one concrete panel formed thereon.

7. The process for lifting large objects in accordance with claim 4 in which said lifting truss lifting cables are attached to a crane supporting said lifting truss.

8. The process for lifting large objects in accordance with claim 1 in which said object being lifted includes a concrete panel having attachment members formed therein, each attachment member being positioned to accept one aligned grapple hook from said lifting truss.

9. A lifting apparatus for lifting a large object comprising:

an elongated lifting truss, said elongated lifting truss having lifting cables attached thereto for lifting said elongated lifting truss;

a plurality of hydraulic cylinders attached to said elongated lifting truss in a spaced relationship to each other, each of said hydraulic cylinders having a hydraulic rod movable in and out thereof responsive to the flow of the hydraulic fluid in each of said hydraulic cylinders;

a hydraulic fluid pump connected to a source of hydraulic fluid;

a pair of hydraulic fluid lines connected between said hydraulic fluid pump and each of said hydraulic cylinders for varying the flow of hydraulic fluid in each of said plurality of hydraulic cylinders; and a plurality of grapple hooks, wherein one of said grapple hooks movably attached to each of said hydraulic cylinder rods and positioned for connecting to an object to be lifted; wherein each of said hydraulic cylinders has one of said grapple hooks movably attached to one said hydraulic cylinder rod;

whereby said lifting truss can be positioned for each of said grapple hooks to connect to an object for lifting the object when said lifting truss is raised.

10. The lifting apparatus for lifting large panels in accordance with claim 9 in which each elongated lifting truss plurality of hydraulic cylinders is movably attached to the elongated lifting truss.

11. The lifting apparatus for lifting large panels in accordance with claim 10 in which the elongated lifting truss includes a pair of hydraulic fluid lines connected between said hydraulic fluid pump and each hydraulic cylinder for varying the flow of hydraulic fluid in each of said plurality of hydraulic cylinders to simultaneously extend or withdraw each hydraulic cylinder rod in each hydraulic cylinder.

12. The lifting apparatus for lifting large panels in accordance with claim 9 in which each object to be lifted has a plurality of attachment members each aligned to receive one said hydraulic cylinder grapple hook.

13. The lifting apparatus for lifting large panels in accordance with claim 12 in which the hydraulic fluid pump and connected source of hydraulic fluid are attached to the elongated lifting truss.

14. The lifting apparatus for lifting large panels in accordance with claim 9 in which the hydraulic fluid pump and connected source of hydraulic fluid are attached to one end of the elongated lifting truss.

* * * * *